US011220752B2

(12) United States Patent
Marenco

(10) Patent No.: US 11,220,752 B2
(45) Date of Patent: Jan. 11, 2022

(54) PROCESS FOR SURFACE TREATMENT OF ALUMINUM OR ALUMINUM ALLOYS BY AN ALKALINE CHEMICAL BATH

(71) Applicant: SIMET S.R.L., Turin (IT)

(72) Inventor: Claudio Marenco, Rosta (IT)

(73) Assignee: SIMET S.R.L.

( * ) Notice: Subject to any disclaimer, the term of this patent is extended or adjusted under 35 U.S.C. 154(b) by 0 days.

(21) Appl. No.: 17/290,848

(22) PCT Filed: Nov. 5, 2019

(86) PCT No.: PCT/IB2019/059478
§ 371 (c)(1),
(2) Date: May 3, 2021

(87) PCT Pub. No.: WO2020/095191
PCT Pub. Date: May 14, 2020

(65) Prior Publication Data

US 2021/0310131 A1 Oct. 7, 2021

(30) Foreign Application Priority Data

Nov. 5, 2018 (IT) ..... 102018000010025

(51) Int. Cl.
*C23F 1/36* (2006.01)
*C23F 1/04* (2006.01)

(52) U.S. Cl.
CPC . *C23F 1/36* (2013.01); *C23F 1/04* (2013.01)

(58) Field of Classification Search
CPC ..... C23F 1/36; C23F 1/04
See application file for complete search history.

(56) References Cited

U.S. PATENT DOCUMENTS 2,650,875 A 9/1953 Dvorkovitz et al.
5,091,046 A * 2/1992 Hunter ..... C23F 1/46 216/93
5,512,129 A * 4/1996 Brodalla ..... C23G 1/36 134/2

OTHER PUBLICATIONS

International Search Report, issued in PCT/IB2019/059478, dated Apr. 15, 2020, Rijswijk, Netherlands.
Strazzi E. et al., Alkaline Etching of Aluminum and Its Alloys—A New Caustic Soda Recovery System, AESF SUR/FIN Proceedings 2002, Jun. 24, 2002, pp. 1-22, US.
Dini J. W., Chemical Milling, International Metallurgical Reviews, Mar. 1, 1975, pp. 29-55, vol. 20, Issue 1, I-M3 Institute of Materials, Minerals and Mining, GB.
Italian Search Report for IT Patent Application No. 2018000010025, dated Jun. 26, 2019, Munich, DE.

* cited by examiner

*Primary Examiner* — Nadine G Norton
*Assistant Examiner* — Mahmoud Dahimene
(74) *Attorney, Agent, or Firm* — Valauskas Corder LLC

(57) ABSTRACT

A process for surface treatment of semi-finished aluminum products is provided. The process includes preparing an aqueous solution of sodium hydroxide (NaOH) and dissolved metallic aluminum, kept in suspension by adding complexing agents including gluconate and sorbitol, and placing a semi-finished aluminum product in contact with the aqueous solution, maintaining temperature of the aqueous solution within a predetermined range.

6 Claims, No Drawings

PROCESS FOR SURFACE TREATMENT OF ALUMINUM OR ALUMINUM ALLOYS BY AN ALKALINE CHEMICAL BATH

CROSS-REFERENCE TO RELATED APPLICATIONS

This application is a U.S. National Phase filing of PCT International Patent Application No. PCT/IB2019/059478, having an international filing date of Nov. 5, 2019, which claims priority to Italian Patent Application No. 102018000010025, filed Nov. 5, 2018 each of which is hereby incorporated by reference in its entirety.

TECHNICAL FIELD

The present invention is generally in the field of metal machining; in particular, the invention refers to a process for the surface treatment of semi-finished products made of aluminum, or of an aluminum alloy, by means of a chemical bath.

PRIOR ART

It is known that in the aeronautical field, processes are used for the surface treatment of metal parts by means of chemical milling.

Chemical milling is a process that consists of treating the surface of the component by means of immersion in an aqueous solution of caustic soda, which etches the metal and removes the surface layers. With this technique, it is possible to generate cavities or contours at different depth levels.

The thickness of the removed layer will mainly depend on the removal speed (variable according to the chemical composition of the solution, i.e., the concentration of soda), as well as the time the semi-finished product stays in contact with the solution.

These parameters also influence the surface finish of the treated piece. In particular, the higher the removal speed, the lower the quality of the resulting surface (because the ability to control the erosion process will generally be lower, as the latter is too fast).

Especially for the treatment of aluminum components, the removal speed becomes a critical parameter, together with the way in which the component chemically interacts with the corrosive solution.

However, in the case of traditional chemical milling, it is not possible to control these factors adequately, nor it is sufficient to dilute the solution by simply reducing the concentration of soda, because a coarse result in terms of surface finish of the piece would still be obtained.

As a result, the uncontrolled corrosive power of the solution leads, on the one hand, to excessively high removal rates and, on the other, to a deterioration of the aesthetic and mechanical properties of the piece, whereby, for example, chemical milling is not used for structural components.

These limitations understandably undermine the possibility of extending this technique to a wider range of applications, even in non-aeronautical contexts (e.g. automotive).

A further example of a chemical milling operation, wherein a gluconate-based complexing agent is added to the caustic soda solution, is known from the article "Alkaline etching of aluminum and its alloys—A new caustic soda recovery system" (Strazzi et Al., AESF SUR/FIN PROCEEDINGS 2002, 24 Jun. 2002, pp. 1-22, XP055599515, [US] ISSN: 0024-3345).

However, even this process has the disadvantage of not allowing optimal control of the removal speed. In addition, the machining yield in terms of surface finish is generally unsatisfactory, because the surface roughness is greater than in the case wherein the piece is subjected to traditional machining.

SUMMARY OF THE INVENTION

An object of the present invention is to remedy the aforesaid problems.

To obtain this result, a process according to the present invention uses an aqueous solution of caustic soda wherein a certain quantity of metallic aluminum is dissolved beforehand (expediently in solid form), kept in suspension by adding complexing agents, by means of which the concentration of aluminum in suspension remains within a predetermined range.

Complexing agents comprising gluconate and sorbitol are also added to the solution.

The aluminum in suspension has the effect of catalyzing the soda, regulating its aggressive action on the semi-finished product to be subjected to surface treatment. The complexing agents prevent the precipitation of aluminum in the form of aluminum hydroxide, and allow the solution to carry out the corrosive action in a controlled manner, i.e. by controlling parameters such as removal speed, surface roughness and degree of finish, etc.

In effect, it was surprisingly found that the presence of a combination of gluconate and sorbitol in solution optimally regulates the removal dynamics of the material from the surface of the semi-finished product. In particular, it was found that this factor greatly influences the removal speed as well as the degree of surface finish.

In particular, as will be better appreciated in the remainder of the present description, with regard to a degree of surface roughness comparable to that obtainable with a traditional bath containing a complexing agent similar to gluconate (the degree of roughness of which is much better than the pieces treated with a conventional chemical milling process that uses a solution of caustic soda in the absence of this complexing agent), with a solution containing a combination of gluconate and sorbitol it is possible to accelerate the complexation and increase the speed of removal, which allows the process to be industrialized and a significantly greater number of pieces to be processed in the same amount of time.

With a process according to the invention, the mechanical properties of the material are not compromised, and it is also possible to treat the semi-finished product in a perfectly uniform manner, even when the component has a complex shape, or it is necessary to perform extremely precise machining, for example to produce small parts, and/or on parts of the piece that are difficult to access.

Moreover, the aesthetic yield of the piece treated by the present process is equal to that which would be obtained with traditional techniques of mechanical removal, sanding and polishing, but with significantly reduced costs. Among other things, the uniformity of the surface of the machined component facilitates any subsequent painting and/or welding operations.

Moreover, the complexing agents used are completely ecological and easy to dispose of, and their use also prevents the bath from releasing toxic gases, with beneficial economic and environmental effects.

The aforesaid and other objects and advantages are achieved, according to an aspect of the present invention, by a process for surface treatment of semi-finished products made of aluminum or aluminum alloy, by contact with or immersion in a chemical solution, as described and claimed herein. Preferred embodiments are also described.

DETAILED DESCRIPTION

Before explaining in detail a plurality of embodiments of the invention, it should be clarified that the invention is not limited in its application to the constructive details presented in the following description or illustrated in the drawings. The invention may assume other embodiments and may in practice be implemented or achieved in different ways. It should also be understood that the phraseology and terminology have descriptive purposes and should not be construed as restrictive.

A process for the treatment of semi-finished aluminum products comprises the step of preparing an aqueous solution of sodium hydroxide (NaOH) at a concentration between 100 g/l and 250 g/l and dissolved metallic aluminum at a concentration between 50 g/l and 70 g/l. Semi-finished aluminum products are products containing aluminum (in monolithic form or alloyed with other metals) so that the aluminum may be etched by such a solution.

An aluminum complexing agent is added to the solution, comprising gluconate and sorbitol, at a concentration between 5 g/l and 25 g/l.

The ratio of the sorbitol concentration (in grams per liter of solution) and the gluconate concentration (in grams per liter of solution) is between 0.7 and 0.75.

In this way, it is possible to maintain the concentrations of soda and aluminum in suspension over time in the right proportions, avoiding the precipitation of the latter.

Moreover, the chemical treatment bath will be environmentally friendly and safe, given the lack of release of toxic gases.

The semi-finished product is placed in contact with the solution, for the time necessary to carry out the desired surface treatment. During this period, the temperature of said solution is maintained in a range between 50° C. and 100° C., and the aluminum concentration dissolved in said solution is maintained in a range between 50 g/l and 70 g/l.

The temperature influences the speed at which the material is removed, while the presence of complexing agents makes it possible to keep the aluminum in solution. It has been found that the combined action of temperature, maintained within the range indicated above, and a concentration of complexing agents in the solution comprised within the aforesaid values, produces a surface finish of surprising quality, when compared to the results that may be obtained by traditional techniques (as will be shown below).

Expediently, the concentrations of caustic soda and aluminum are maintained in the desired ranges by titration of the aqueous solution.

Expediently, the contact between the solution and the semi-finished product is made by immersing the semi-finished product in a tank containing the solution.

The step of masking the semi-finished product prior to contact with the solution may also be provided, so that the solution etches only the unmasked parts of the piece.

Preferably, the dimensions and/or the finishing state of the semi-finished product in contact with said solution are periodically checked, to verify the state of progress of the machining operation, with reference to the expected result.

Optionally, there may be a step of filtering the solution with a filter (known per se) configured so as to catalyze the dissolved aluminum and dissociate the latter from the solution.

One of the advantages achieved, in addition to the improved aesthetic yield and the possibility of carrying out machining operations that do not adversely affect the mechanical properties of the material, concerns the effective removal of alumina ($Al_2O_3$) that is formed by components obtained by casting, and subsequent solidification. In fact, in the known art, the mechanical removal of alumina is traditionally used, with the result of causing residual stresses in the component and making it necessary to undergo further heat treatment to remove them. A process according to the present invention makes it possible to avoid this step, since it makes it possible to remove effectively the alumina generated in a perfectly uniform manner.

As far as low-pressure castings are concerned, whereby castings are obtained with aluminum-bound sand, it is interesting to note that this sand may be removed with absolute ease. The same applies to aluminum and the alloys thereof.

Moreover, the ability to remove small amounts of material, reducing the thickness of the component, makes the process, according to the invention, a widely desirable type of machining in the automotive field, especially in the field of sports and racing vehicles, wherein the weight factor is important, and one could hardly achieve a sufficiently precise machining (and one that does not affect the mechanical properties of the piece) through a common chip removal or forming process, or by using traditional chemical milling, which would give results that are too coarse.

For these reasons, through a process according to the present invention, it is possible to treat, for example, structural details, which could not be machined properly with traditional chemical milling techniques.

Different aspects and embodiments of a process for the surface treatment of semi-finished products made of aluminum, or of aluminum alloy, by means of a chemical bath, according to the invention, have been described. It is understood that each embodiment may be combined with any other embodiment. The invention, moreover, is not limited to the described embodiments, but may be varied within the scope defined by the accompanying claims.

EXPERIMENTAL VALIDATION OF THE INVENTION

Comparative tests have been carried out between specimens made of aluminum alloy treated both according to a traditional chemical milling process and according to a process according to the present invention.

In particular, the specimens were made from the aluminum alloy identified as alloy AL 6014 (Al—Mg—Si).

A plurality of specimens, obtained by rolling, were immersed in a solution according to the present invention, comprising caustic soda (at a concentration of 150 g/l), aluminum (at an initial concentration of 50 g/l), and a combination of gluconate and sorbitol (at concentrations of 8.5 g/l and 6.2 g/l respectively), for a total time of 1 hour and 45 minutes, divided into 7 intervals of 15 minutes each. At the end of each interval, the specimen was extracted from the solution to check the progress of the operation, and then immersed again for the next time interval. Throughout the procedure, the temperature of the solution was kept constant at 50° C., and the concentration of dissolved aluminum in this solution was kept at 50 g/l.

Under the aforesaid conditions, a removal speed value was detected in the range of 0.008 mm/min to 0.0083 mm/min. In addition, the value of the surface roughness of the specimen, at the end of the treatment, was in the range of 0.62 μm to 1.01 μm.

According to similar test methods, specimens of the same alloy AL 6014 were immersed in a solution comprising caustic soda (at a concentration of 70 g/l), aluminum (at an initial concentration of 40 g/l), and sorbitol (at a concentration of 40 g/l). Throughout the entire procedure, the temperature of the solution was kept constant at 50° C., and the concentration of dissolved aluminum in this solution was kept at 40 g/l.

Under the aforesaid conditions, a removal speed value was detected in the range of 0.00124 mm/min to 0.00129 mm/min. In addition, the value of the surface roughness of the specimen, at the end of the treatment, was in a range of 0.81 μm to 1.02 μm.

Finally, according to similar test methods, specimens of the same alloy AL 6014 were immersed in a solution of caustic soda at a concentration of 120 g/l, traditionally used in the chemical milling of components in aeronautics. In this case, the removal rate was between 0.05 mm/min and 0.12 mm/min, and the surface roughness was between 2.00 μm and 3.80 μm.

The results show that the surface roughness of the specimens machined by means of a process according to the present invention is less or substantially similar to the surface roughness of the specimens immersed in a solution containing sorbitol as a complexing agent (not in combination with gluconate), with a decidedly better yield in terms of surface finish than in the case of a solution containing only caustic soda. At the same time, however, removal speed values were obtained that were significantly higher (by more than 6 times) than those achievable by treating the specimens with a solution containing only sorbitol as a complexing agent.

This allows more semi-finished products to be processed, while achieving high standards of surface finish.

The invention claimed is:

1. A process for surface treatment of aluminum or aluminum alloy semi-finished products, comprising the steps of:

(a) preparing an aqueous solution of sodium hydroxide (NaOH) in a concentration between 100 g/l and 250 g/l and dissolved metallic aluminum in a concentration between 50 g/l and 70 g/l;

(b) adding to said aqueous solution an aluminum complexing agent, comprising gluconate and sorbitol, in a concentration between 5 g/l and 25 g/l, the ratio between the concentration of sorbitol in grams per liter of solution and the concentration of gluconate in grams per liter of solution being between 0.7 and 0.75;

(c) placing a semi-finished product in contact with the aqueous solution, for a time necessary to carry out a desired surface treatment; and (d) during step (c), maintaining temperature of said aqueous solution in a range between 50° C. and 100° C., and maintaining the concentration of metallic aluminum dissolved in said aqueous solution in a range between 50 g/l and 70 g/l.

2. The process of claim 1, wherein concentrations of sodium hydroxide and metallic aluminum are maintained in the ranges indicated in step (a) by titration of the aqueous solution.

3. The process of claim 1, wherein step (c) is implemented by immersing the semi-finished product in a tank containing the aqueous solution.

4. The process of claim 1, further comprising the step of masking the semi-finished product prior to contact of the semi-finished product with the aqueous solution.

5. The process of claim 1, further comprising the step of periodically checking dimensions and/or finishing state of the semi-finished product in contact with said aqueous solution.

6. The process of claim 1, further comprising the step of filtering the aqueous solution with a filter configured to catalyze the dissolved metallic aluminum and dissociate the dissolved metallic aluminum from said aqueous solution.

* * * * *